US011242754B2

(12) United States Patent
Lee et al.

(10) Patent No.: US 11,242,754 B2
(45) Date of Patent: Feb. 8, 2022

(54) GAS TURBINE DISK

(71) Applicant: DOOSAN HEAVY INDUSTRIES & CONSTRUCTION CO., LTD., Changwon-si (KR)

(72) Inventors: Ji Moon Lee, Daegu (KR); Yong Hyun Lim, Busan (KR)

( * ) Notice: Subject to any disclaimer, the term of this patent is extended or adjusted under 35 U.S.C. 154(b) by 189 days.

(21) Appl. No.: 16/137,620

(22) Filed: Sep. 21, 2018

(65) Prior Publication Data

US 2019/0120057 A1 Apr. 25, 2019

(30) Foreign Application Priority Data

Oct. 19, 2017 (KR) ..... 10-2017-0135914

(51) Int. Cl.
*F01D 5/08* (2006.01)

(52) U.S. Cl.
CPC ..... *F01D 5/087* (2013.01); *F01D 5/081* (2013.01); *F05D 2220/32* (2013.01); *F05D 2260/232* (2013.01); *F05D 2260/941* (2013.01)

(58) Field of Classification Search
CPC ..... F01D 5/081; F01D 5/082; F01D 5/085; F01D 5/087; F01D 5/08
See application file for complete search history.

(56) References Cited

U.S. PATENT DOCUMENTS 2,931,623 A * 4/1960 Hyde ..... F01D 5/08 416/92
3,356,339 A * 12/1967 Thomas ..... F01D 5/066 416/244 R
3,635,586 A * 1/1972 Kent ..... F01D 5/081 416/97 R
4,522,562 A * 6/1985 Glowacki ..... F01D 5/187 416/95
5,122,033 A 6/1992 Paul
5,957,660 A * 9/1999 Evans ..... F01D 5/084 415/115
5,984,637 A * 11/1999 Matsuo ..... F01D 5/081 415/115
6,022,190 A * 2/2000 Schillinger ..... F01D 5/081 415/115
6,565,318 B1 * 5/2003 Tiemann ..... F01D 5/087 416/97 R
6,988,367 B2 * 1/2006 Thompson, Jr. ..... F01D 5/085 60/744

(Continued)

FOREIGN PATENT DOCUMENTS

JP H09-303103 A 11/1997
JP 2002-540347 A 11/2002

(Continued)

OTHER PUBLICATIONS

A Korean Office Action dated Dec. 11, 2018 in connection with Korean Patent Application No. 10-2017-0135914 which corresponds to the above-referenced U.S. application.

*Primary Examiner* — Woody A Lee, Jr.
*Assistant Examiner* — Wesley Le Fisher
(74) *Attorney, Agent, or Firm* — Harvest IP Law, LLP

(57) ABSTRACT

Disclosed herein is a gas turbine disk that includes a cooling target, and a disk unit having a main passage that is open to supply cooling air to the cooling target, and a plurality of unit passages that are open at an end of the main passage while each having a predetermined size.

11 Claims, 8 Drawing Sheets

(56) References Cited

U.S. PATENT DOCUMENTS

| | | | | |
|---|---|---|---|---|
| 8,622,701 | B1 * | 1/2014 | Liang | F01D 5/081 415/115 |
| 9,032,738 | B2 * | 5/2015 | Laurello | F02C 6/08 60/782 |
| 2002/0168264 | A1 * | 11/2002 | Weigand | F01D 5/187 416/97 R |
| 2007/0003407 | A1 * | 1/2007 | Turner | F01D 5/18 415/115 |
| 2009/0060712 | A1 * | 3/2009 | De Cardenas | F01D 5/081 415/115 |
| 2011/0123325 | A1 * | 5/2011 | Morris | F01D 5/3015 415/208.1 |
| 2012/0148406 | A1 * | 6/2012 | Halfmann | F01D 5/3007 416/95 |
| 2012/0207615 | A1 * | 8/2012 | Ahmad | F01D 5/187 416/97 R |
| 2013/0283813 | A1 * | 10/2013 | Laurello | F02C 6/08 60/782 |
| 2017/0101870 | A1 * | 4/2017 | Lewis | F01D 5/186 |

FOREIGN PATENT DOCUMENTS

| | | | |
|---|---|---|---|
| KR | 10-2011-0021933 | A | 3/2011 |
| KR | 10-2011-0079075 | A | 7/2011 |

* cited by examiner

[FIG. 1]
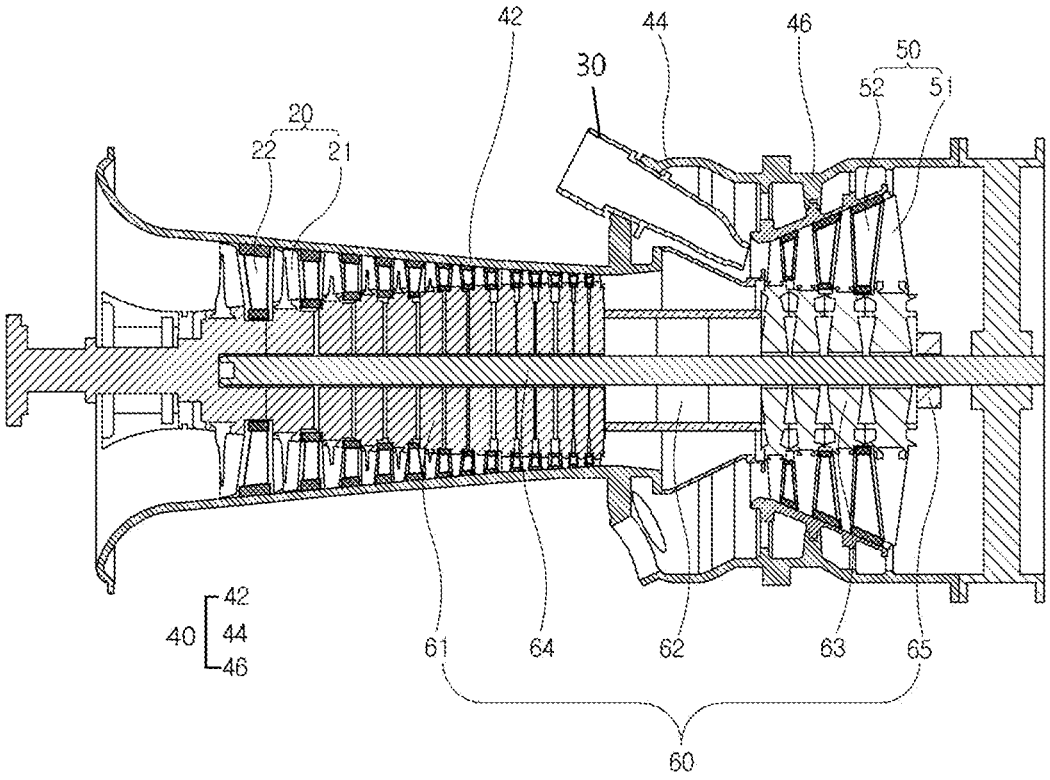

[FIG. 2]
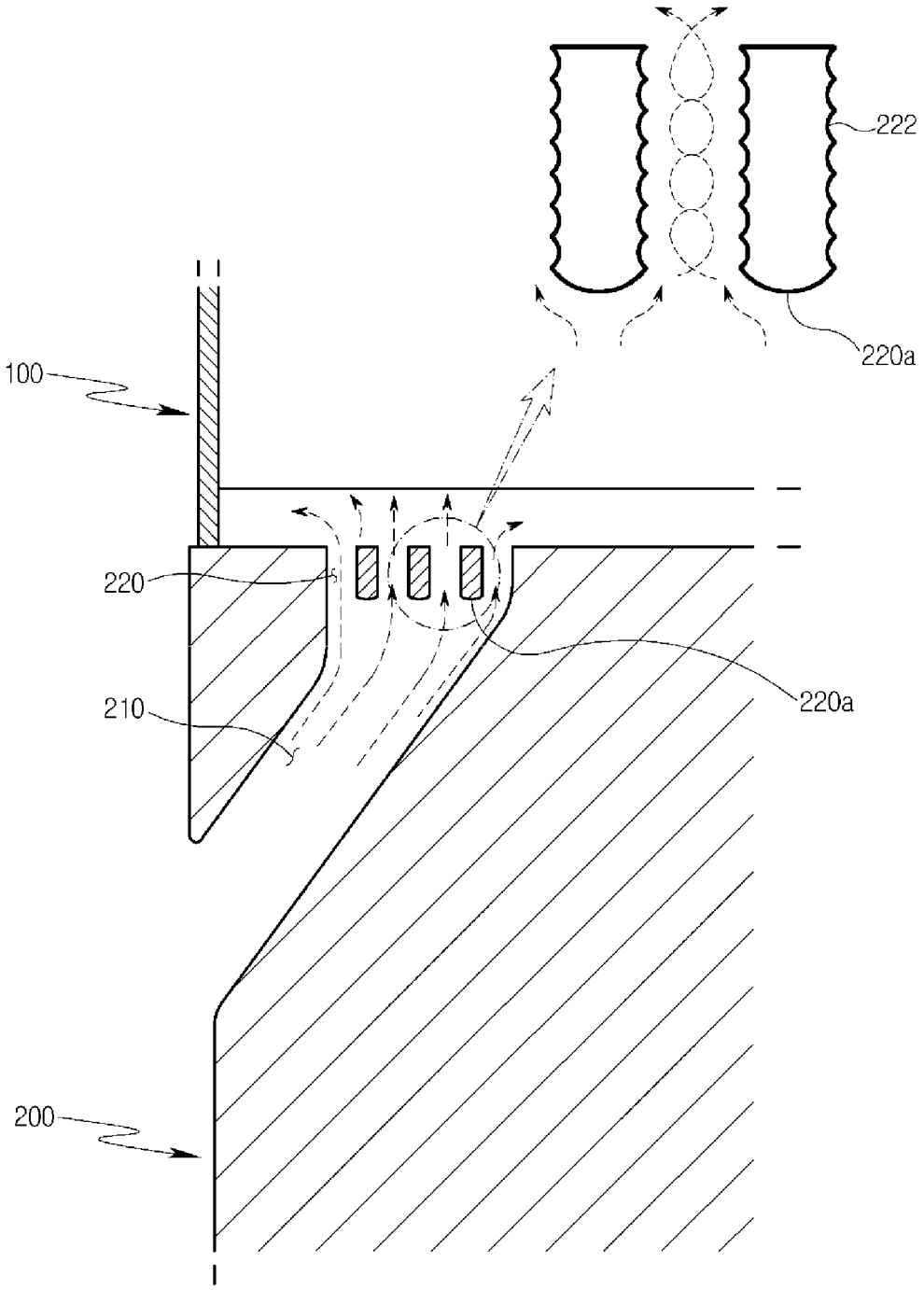

[FIG. 3]
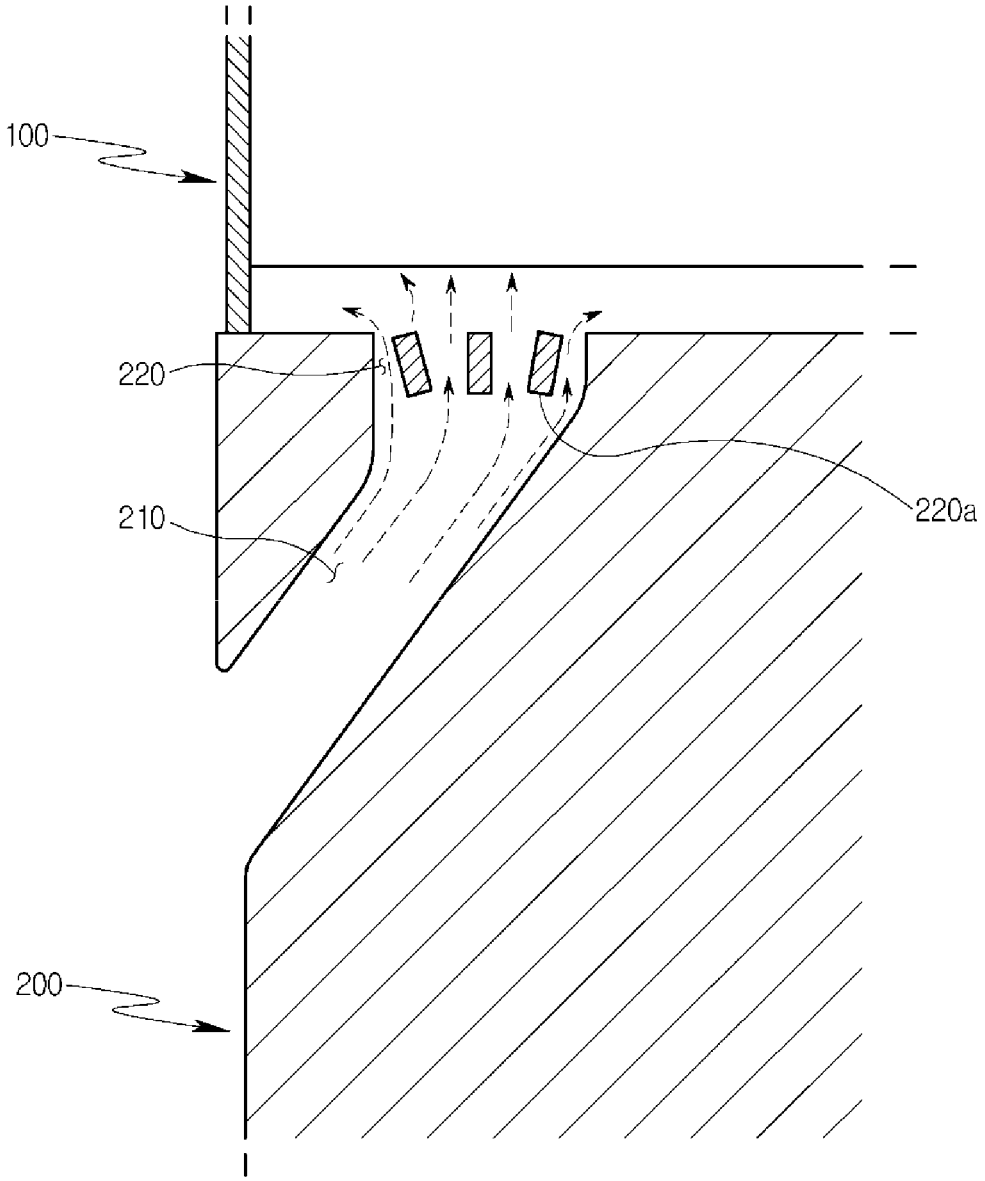

[FIG. 4]
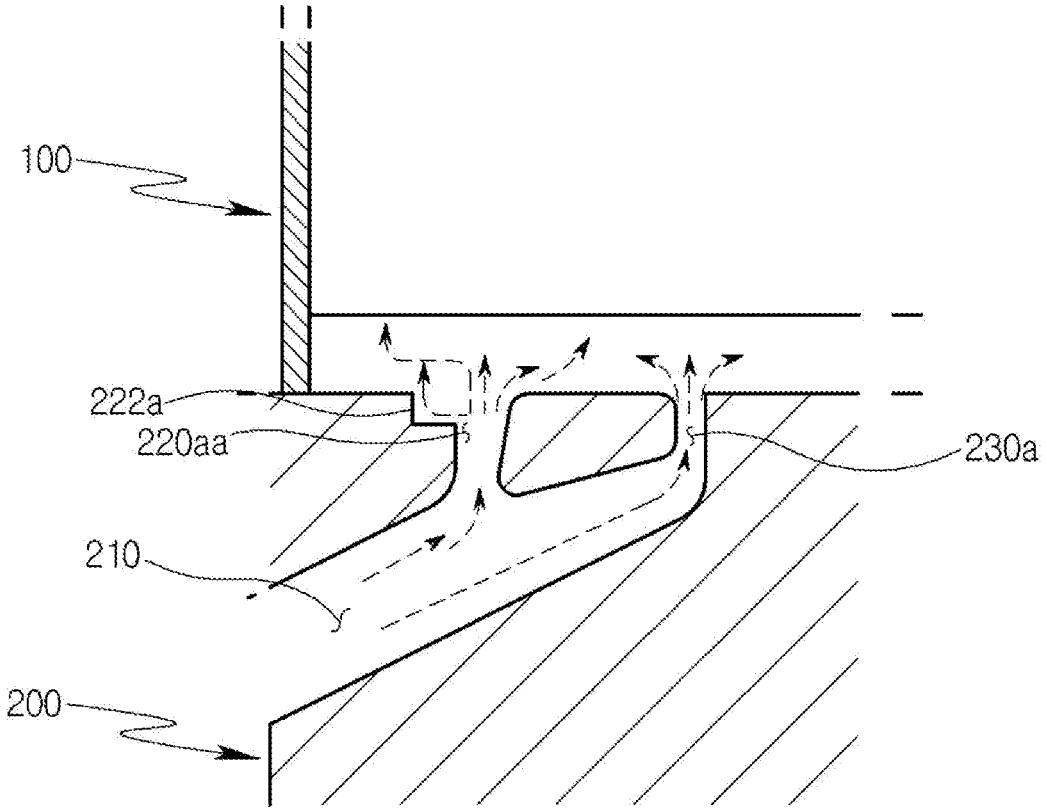

[FIG. 5]
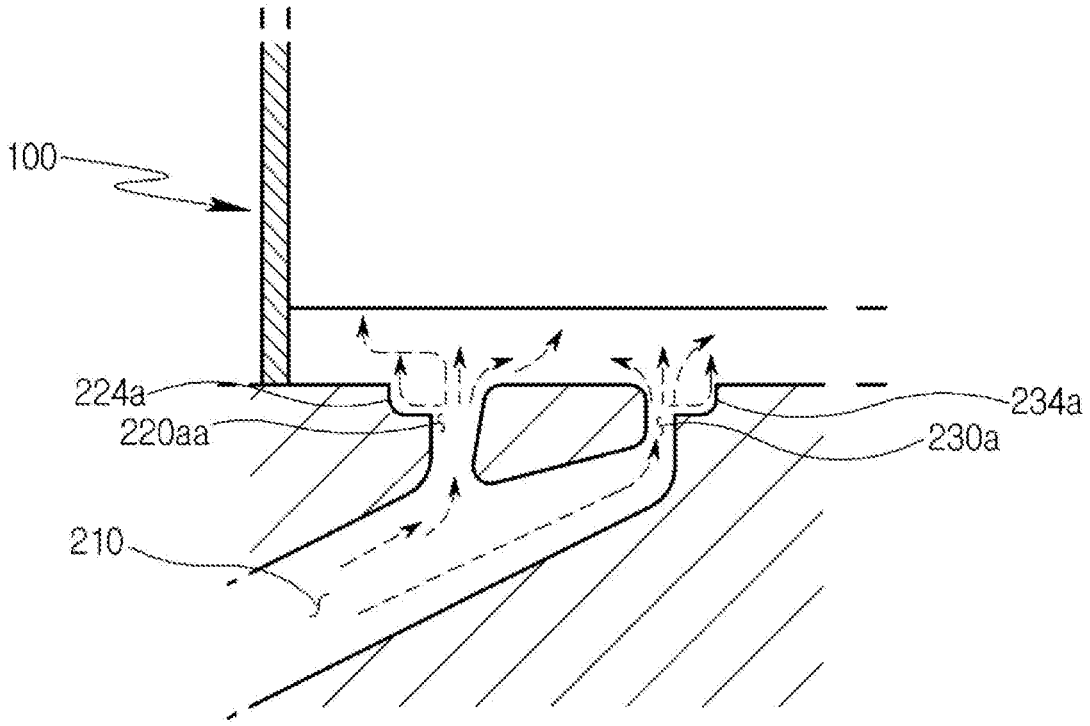

[FIG. 6]
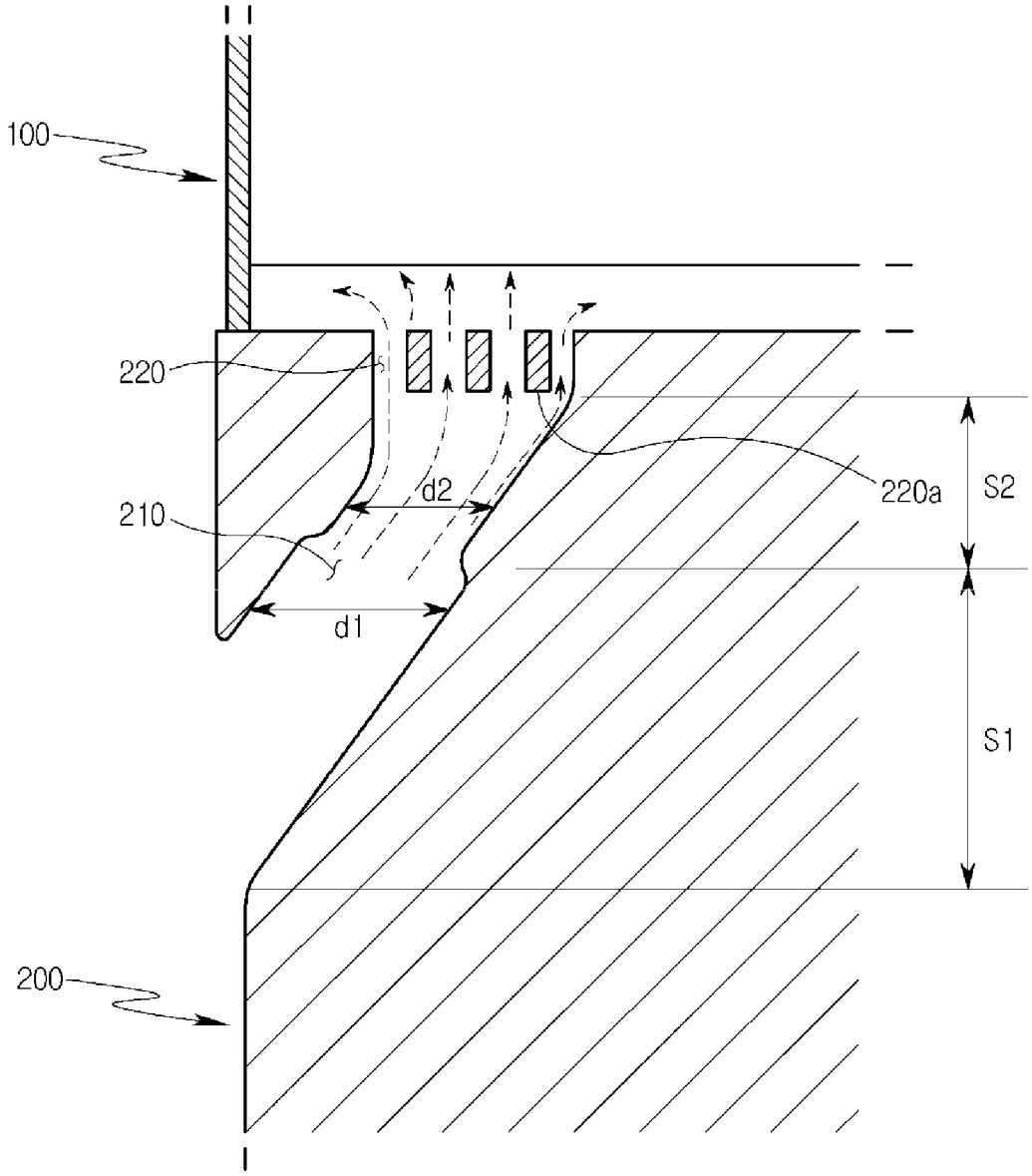

[FIG. 7]
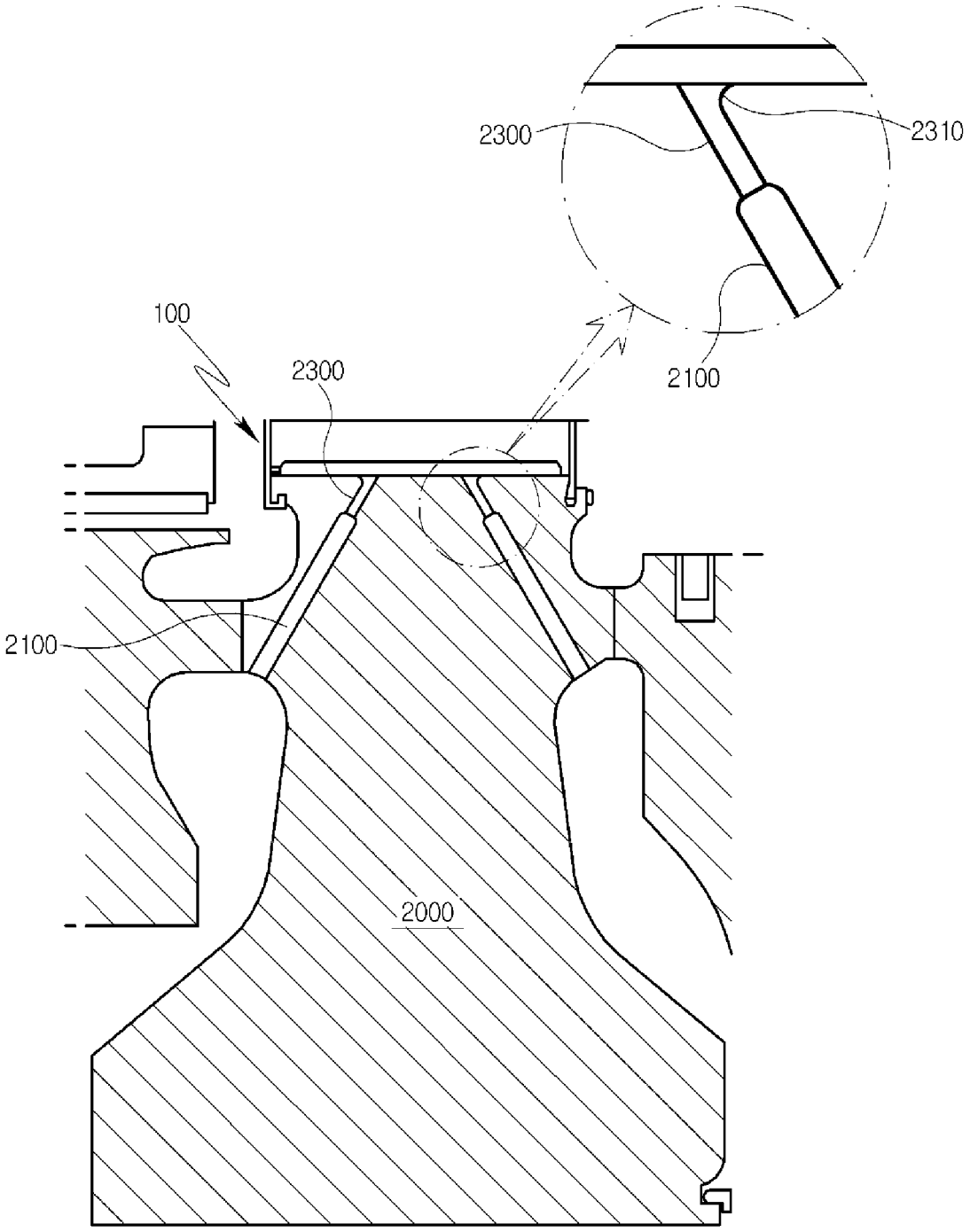

[FIG. 8]
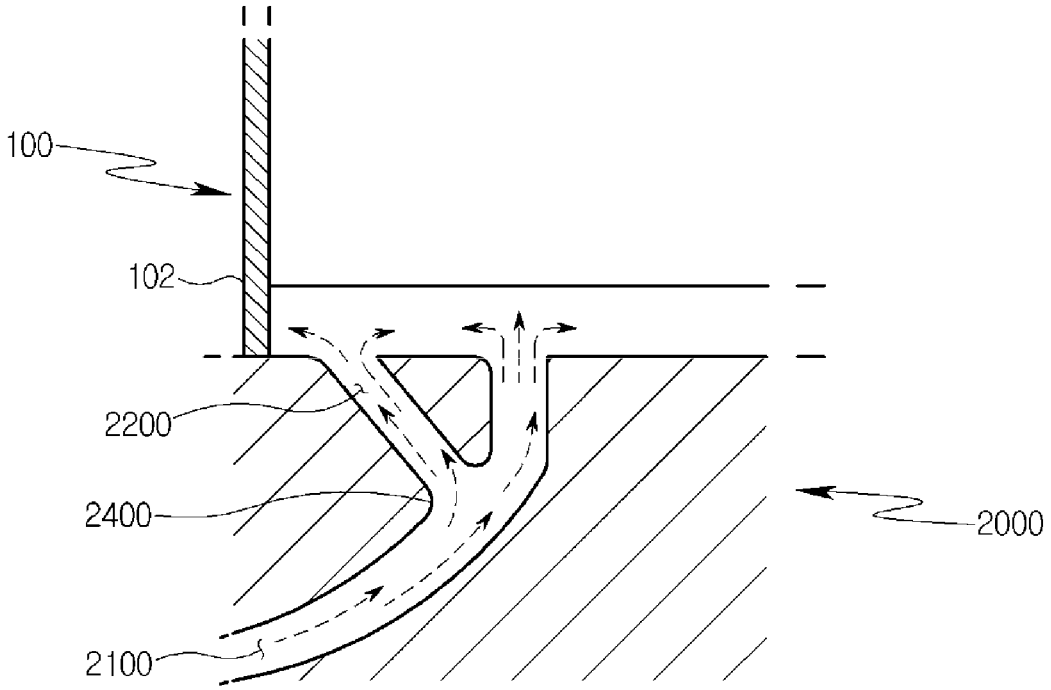

GAS TURBINE DISK

CROSS-REFERENCE TO RELATED APPLICATION(S)

This application claims priority to Korean Patent Application No. 10-2017-0135914, filed on Oct. 19, 2017 the disclosure of which is incorporated herein by reference in its entirety.

BACKGROUND OF THE INVENTION

Field of the Invention

Exemplary embodiments of the present disclosure relate to a cooling passage formed within a disk unit of a gas turbine, and more particularly, to a gas turbine disk that minimizes stress concentration on a structure by cooling air supplied to a cooling target.

Description of the Related Art

In general, a turbine is a machine that converts the energy of a fluid such as water, gas, or steam into mechanical work, and is typically referred to as a turbomachine in which many buckets or blades are mounted to the circumference of a rotating body and steam or gas is emitted thereto to rotate the rotating body at high speed by impulsive or reaction force.

Examples of the turbine include a water turbine using the energy of high-positioned water, a steam turbine using the energy of steam, an air turbine using the energy of high-pressure compressed air, a gas turbine using the energy of high-temperature and high-pressure gas, and the like.

Among them, the gas turbine includes a compressor, a combustor, turbine, and a rotor. The compressor includes a plurality of compressor vanes and compressor blades arranged alternately.

The combustor supplies fuel to air compressed by the compressor and ignites a mixture thereof with a burner to thereby produce high-temperature and high-pressure combustion gas.

The turbine includes a plurality of turbine vanes and turbine blades arranged alternately.

The rotor is formed to pass through the centers of the compressor, combustor, and turbine. The rotor is rotatably supported at both ends thereof by bearings, and one end of thereof is connected to a drive shaft of a generator.

The rotor includes a plurality of compressor rotor disks, each of which is fastened to the compressor blades, a plurality of turbine rotor disks, each of which is fastened to the turbine blades, and a torque tube that transmits rotational force from the turbine rotor disks to the compressor rotor disks.

In the gas turbine having the above structure, air compressed by the compressor is mixed with fuel for combustion in the combustion chamber to produce hot combustion gas, the produced combustion gas is injected to the turbine, and the injected combustion gas generates rotational force while passing through the turbine blades, thereby rotating the rotor.

This gas turbine is advantageous in that consumption of lubricant is extremely low due to the absence of mutual friction parts such as a piston-cylinder since it does not have a reciprocating mechanism such as a piston in a four-stroke engine, the amplitude, which is a characteristic of reciprocating machines, is greatly reduced, and it enables high-speed motion.

In the gas turbine having these features, for example, cooling air is supplied to a blade or a vane for the cooling thereof due to hot gas. In this case, a surface cooling method is mainly used in which cooling air is injected from holes formed in end wall supporting the vane.

The cooling air is supplied at a predetermined pressure, in which case deformation may occur at a specific position where a stress is concentrated in the passage formed within the blade or the vane. Therefore, there is a need for addressing such issues.

SUMMARY OF THE INVENTION

An object of the present disclosure is to provide a gas turbine disk that minimizes a fatigue failure or an increase in stress due to stress concentration in a disk unit of a gas turbine.

Other objects and advantages of the present disclosure can be understood by the following description, and become apparent with reference to the embodiments of the present disclosure. Also, it is obvious to those skilled in the art to which the present disclosure pertains that the objects and advantages of the present disclosure can be realized by the means as claimed and combinations thereof.

In accordance with a first aspect of the present disclosure, a gas turbine disk includes a cooling target (100) related to a gas turbine, and a disk unit (200) having a main passage (210) that is open to supply cooling air to the cooling target (100), and a plurality of unit passages (220) that are open at an end of the main passage (210) while each having a predetermined size.

The unit passages (220) may be open vertically toward the cooling target (100).

The unit passages (220) may be open obliquely toward the cooling target (100).

The unit passages (220) may be open in one of circular, elliptical, and polygonal forms.

Each of the unit passages (220) may have a rounded portion (220*a*) formed at its lower side.

Each of the unit passages (220) may have a spiral groove portion (222) formed circumferentially therein.

The main passage (210) may include a first extension section (S1) formed to have a first length in a total extension section (S) to the unit passages (220), and a second extension section (S2) extending from an extended end of the first extension section (S1) to the unit passages (220) while having a second length, and a diameter (d1) of the first extension section (S1) may differ from a diameter (d2) of the second extension section (S2).

There is provided a gas turbine including the gas turbine disk according to the first aspect of the present disclosure.

In accordance with a second aspect of the present disclosure, a gas turbine disk includes a cooling target (100) related to a gas turbine, and a disk unit (200) having a main passage (210) that is open to supply cooling air to the cooling target (100), a first branch passage (220*aa*) branched from the main passage (210) to supply cooling air to a high-temperature area in an extended path of the main passage (210), and a second branch passage (230*a*) separated from the first branch passage (220*aa*) to supply cooling air to a remainder area of the cooling target (100).

The first branch passage (220*aa*) may have a diameter greater than the second branch passage (230*a*).

The first branch passage (220*aa*) may be branched adjacent to the main passage (210) rather than the second branch passage (230*a*).

The main passage (210) may have a diameter that is uniformly maintained in an extended section between the first branch passage (220*aa*) and the second branch passage (230*a*).

The first branch passage (220*aa*) may have a first expansion portion (222*a*) formed to have a predetermined diameter and depth at its open end.

The first and second branch passages (220*a* and 230*a*) may have second expansion portions (224*a* and 234*a*) that are rounded and expanded circumferentially outward in respective open upper sides thereof.

In accordance with a third aspect of the present disclosure, a gas turbine disk includes a cooling target (100) related to a gas turbine, and a disk unit (2000) having a main passage (2100) extending to supply cooling air to the cooling target (100), and a segmentation passage (2200) segmented and extending from the main passage (2100) to supply the cooling air to a leading edge (102) of the cooling target (100).

The segmentation passage (2200) may have a rounded portion (2400) formed at a position in which it is segmented from the main passage (2100).

In accordance with a fourth aspect of the present disclosure, a gas turbine disk includes a cooling target (100) related to a gas turbine, and a disk unit (2000) having main passages (2100) that are open to supply cooling air to the cooling target (100), and branch passages (2300) connected to extended ends of the respective main passages (2100), communicating with the cooling target (100), and having a diameter different from the main passages (2100), wherein the main passages (2100) and the branch passages (2300) are symmetrically disposed in a lower side of the disk unit (2000).

Each of the branch passages (2300) may be inclined at an angle within 30° with respect to an associated one of the main passages (2100).

The main passages (2100) may be longer than the branch passages (2300).

It is to be understood that both the foregoing general description and the following detailed description of the present disclosure are exemplary and explanatory and are intended to provide further explanation of the disclosure as claimed.

BRIEF DESCRIPTION OF THE DRAWINGS

The above and other objects, features and other advantages of the present disclosure will be more clearly understood from the following detailed description taken in conjunction with the accompanying drawings, in which:

FIG. 1 is a cross-sectional view illustrating an overall configuration of a gas turbine according to a first embodiment of the present disclosure;

FIG. 2 is a view illustrating a disk unit according to the first embodiment of the present disclosure;

FIG. 3 is a view illustrating a modified example of FIG. 2;

FIG. 4 is a view illustrating another modified example of FIG. 2;

FIG. 5 is a view illustrating a disk unit according to a second embodiment of the present disclosure;

FIG. 6 is a view illustrating a modified example of FIG. 5;

FIG. 7 is a view illustrating a disk unit according to a third embodiment of the present disclosure; and FIG. 8 is a view illustrating a disk unit according to a fourth embodiment of the present disclosure.

DESCRIPTION OF SPECIFIC EMBODIMENTS

Reference will now be made in detail to exemplary embodiments of the present disclosure, examples of which are illustrated in the accompanying drawings. The present disclosure may, however, be embodied in different forms and should not be construed as limited to the embodiments set forth herein. Rather, these embodiments are provided so that this disclosure will be thorough and complete, and will fully convey the scope of the present disclosure to those skilled in the art. Throughout the disclosure, like reference numerals refer to like parts throughout the various figures and embodiments of the present disclosure.

Hereinafter, a configuration of a gas turbine according to an embodiment of the present disclosure will be described with reference to the accompanying drawings.

Referring to FIG. 1, a gas turbine according to a first embodiment of the present disclosure includes a rotor 60 that is rotatably provided in a housing 40, and a compressor 20 that compresses air introduced into the housing 40 by the rotational force transmitted from the rotor 60.

The gas turbine includes a combustor 30 that produces combustion gas by mixing fuel with the air compressed in the compressor 20 and igniting a mixture thereof, a turbine 50 that rotates the rotor 60 by the rotational force obtained from the combustion gas produced in the combustor 30, a generator that is operatively connected to the rotor 60 for power generation, and a diffuser that discharges the combustion gas having passed through the turbine 50.

The housing 40 includes a compressor housing 42 that accommodates the compressor 20 therein, a combustor housing 44 that accommodates the combustor 30 therein, and a turbine housing 46 that accommodates the turbine 50 therein.

The compressor housing 42, the combustor housing 44, and the turbine housing 46 are subsequently arranged from upstream (the compressor disposed to the left of the drawing) to downstream (the turbine disposed to the right of the drawing) in the flow direction of fluid.

The rotor 60 includes a compressor rotor disk 61 that is accommodated in the compressor housing 42, a turbine rotor disk 63 that is accommodated in the turbine housing 46, a torque tube 62 that is accommodated in the combustor housing 44 to connect the compressor rotor disk 61 and the turbine rotor disk 63, and a tie rod 64 and a fixing nut 65 that fasten the compressor rotor disk 61, the torque tube 62, and the turbine rotor disk 63 to one another.

The compressor rotor disk 61 may consist of a plurality of compressor rotor disks arranged in the axial direction of the rotor 60. For example, the compressor rotor disks 61 may be formed in a multistage manner.

Each of the compressor rotor disks 61 has, for example, a disk shape, and may have a compressor blade coupling slot formed in the outer peripheral portion thereof such that a compressor blade 21 to be described later is coupled to the compressor blade coupling slot.

The compressor blade coupling slot may have a fir-tree shape to prevent the decoupling of the compressor blade 21 from the compressor blade coupling slot in the radial direction of the rotor 60.

The compressor rotor disk 61 is typically coupled to the compressor blade 21 in a tangential-type or axial-type manner.

In the present embodiment, the compressor rotor disk 61 and the compressor blade 21 are coupled to each other in the axial-type manner. The compressor blade coupling slot may consist of a plurality of compressor blade coupling slots arranged radially in the circumferential direction of the compressor rotor disk 61.

The turbine rotor disk 63 may be formed similar to the compressor rotor disk 61. The turbine rotor disk 63 may consist of a plurality of turbine rotor disks arranged in the axial direction of the rotor 60. For example, the turbine rotor disks 63 may be formed in a multistage manner.

Each of the turbine rotor disks 63 has a substantially disk shape, and may have a turbine blade coupling slot formed in the outer peripheral portion thereof such that a turbine blade 51 to be described later is coupled to the turbine blade coupling slot.

The turbine blade coupling slot may have a fir-tree shape to prevent the decoupling of the turbine blade 51 from the turbine blade coupling slot in the radial direction of the rotor 60.

Here, the turbine rotor disk 63 is typically coupled to the turbine blade 51 in a tangential-type or axial-type manner. In the present embodiment, the turbine rotor disk 63 and the turbine blade 51 are coupled to each other in the axial-type manner. Thus, the turbine blade coupling slot according to the present embodiment may consist of a plurality of turbine blade coupling slots arranged radially in the circumferential direction of the turbine rotor disk 63.

The torque tube 62 is a torque transmission member that transmits the rotational force of the turbine rotor disk 63 to the compressor rotor disk 61. One end of the torque tube 62 is fastened to a compressor rotor disk 61, which is positioned at the most downstream side in the flow direction of air, from among the plurality of compressor rotor disks 61, and the other end of the torque tube 62 is fastened to a turbine rotor disk 63, which is positioned at the most upstream side in the flow direction of combustion gas, from among the plurality of turbine rotor disks 63.

The torque tube 62 has a protrusion formed at each of one end and the other end thereof, and each of the compressor rotor disk 61 and the turbine rotor disk 63 has a groove engaged with the protrusion. Thus, it is possible to prevent the torque tube 62 from rotating relative to the compressor rotor disk 61 and the turbine rotor disk 63.

The torque tube 62 has a hollow cylindrical shape such that the air supplied from the compressor 20 flows to the turbine 50 through the torque tube 62.

The torque tube 62 may be formed to be resistant to deformation and distortion due to the characteristics of the gas turbine that continues to operate for a long time, and may be easily assembled and disassembled for easy maintenance.

The tie rod 64 is formed to pass through the plurality of compressor rotor disks 61, the torque tube 62, and the plurality of turbine rotor disks 63. One end of the tie rod 64 may be fastened to a compressor rotor disk 61, which is positioned at the most upstream side in the flow direction of air, from among the plurality of compressor rotor disks 61, and the other end of the tie rod 64 may protrude in a direction opposite to the compressor 20 with respect to a turbine rotor disk 63, which is positioned at the most downstream side in the flow direction of combustion gas, from among the plurality of turbine rotor disks 63, to be fastened to the fixing nut 65.

Here, the fixing nut 65 is provided to press the most downstream turbine rotor disk 63 toward the compressor 20.

The plurality of compressor rotor disks 61, the torque tube 62, and the plurality of turbine rotor disks 63 may be compressed in the axial direction of the rotor 60 according to which the distance between the most upstream compressor rotor disk 61 and the most downstream turbine rotor disk 63 is reduced.

Therefore, it is possible to prevent the axial movement and relative rotation of the plurality of compressor rotor disks 61, the torque tube 62, and the plurality of turbine rotor disks 63.

Although one tie rod 64 is formed to pass through the centers of the plurality of compressor rotor disks 61, the torque tube 62, and the plurality of turbine rotor disks 63 in the present embodiment, the present disclosure is not limited thereto.

That is, a separate tie rod 64 may be provided in each of the compressor 20 and the turbine 50, a plurality of tie rods 64 may be arranged circumferentially and radially, or a combination thereof may be used.

Through such a configuration, the rotor 60 may be rotatably supported at both ends thereof by bearings and one end thereof may be connected to the drive shaft of the generator.

The compressor 20 may include a compressor blade 21 that rotates together with the rotor 60, and a compressor vane 22 that is fixedly installed in the housing 40 to align the flow of air introduced into the compressor blade 21.

The compressor blade 21 may consist of a plurality of compressor blades arranged in a multistage manner in the axial direction of the rotor 60, and the plurality of compressor blades 21 may be formed radially in the direction of rotation of the rotor 60 for each stage.

Each of the compressor blades 21 may include a plate-shaped compressor blade platform, a compressor blade root that extends inward from the compressor blade platform in the radial direction of the rotor 60, and a compressor blade airfoil that extends outward from the compressor blade platform in the radial direction of the rotor 60.

The compressor blade platform may be in contact with a compressor blade platform adjacent thereto, and serve to maintain the distance between the compressor blade airfoil and another compressor blade airfoil.

The compressor blade root may be formed in a so-called axial-type manner in which the compressor blade root is inserted into the above-mentioned compressor blade coupling slot in the axial direction of the rotor 60.

The compressor blade root may have a fir-tree shape so as to correspond to the compressor blade coupling slot.

Although the compressor blade root and the compressor blade coupling slot have a fir-tree shape in the present embodiment, the present disclosure is not limited thereto. For example, they may also have a dovetail shape or the like. In addition, the compressor blade 21 may be fastened to the compressor rotor disk 61 using a fastener other than the above form, for example using a fixture such as a key or a bolt.

In order to easily fasten the compressor blade root to the compressor blade coupling slot, the size of the compressor blade coupling slot may be greater than that of the compressor blade root and a gap may be formed between the compressor blade root and the compressor blade coupling slot in the state in which they are coupled to each other.

Although not separately illustrated in the drawings, the compressor blade root may be fixed to the compressor blade coupling slot by a separate pin to prevent the decoupling of the compressor blade root from the compressor blade coupling slot in the axial direction of the rotor 60.

The compressor blade airfoil may have an optimized airfoil shape according to the specifications of the gas turbine, and include a leading edge that is positioned upstream in the flow direction of air so that air comes into contact with the leading edge, and a trailing edge that is positioned downstream in the flow direction of air so that air comes into contact with the trailing edge.

The compressor vane 22 may consist of a plurality of compressor vanes formed in a multistage manner in the axial direction of the rotor 60. Here, the compressor vane 22 and the compressor blade 21 may be arranged alternately in the flow direction of air.

The plurality of compressor vanes 22 may be formed radially in the direction of rotation of the rotor 60 for each stage.

Each of the compressor vanes 22 may include an annular compressor vane platform that is formed in the direction of rotation of the rotor 60, and a compressor vane airfoil that extends from the compressor vane platform in the radial direction of the rotor 60.

The compressor vane platform may include a root-side compressor vane platform that is formed at the airfoil root portion of the compressor vane airfoil to be fastened to the compressor housing 42, and a tip-side compressor vane platform that is formed at the airfoil tip portion of the compressor vane airfoil to face the rotor 60.

Although the compressor vane platform includes the root-side compressor vane platform and the tip-side compressor vane platform to more stably support the compressor vane airfoil by supporting the airfoil tip portion of the compressor vane airfoil as well as the airfoil root portion thereof in the present embodiment, the present disclosure is not limited thereto.

That is, the compressor vane platform may also include the root-side compressor vane platform to support only the airfoil root portion of the compressor vane airfoil.

The compressor vane airfoil may have an optimized airfoil shape according to the specifications of the gas turbine, and include a leading edge that is positioned upstream in the flow direction of air so that air comes into contact with the leading edge, and a trailing edge that is positioned downstream in the flow direction of air so that air comes into contact with the trailing edge.

The combustor 30 may mix the air introduced from the compressor 20 with fuel and burn a mixture thereof to produce high-temperature and high-pressure combustion gas with high energy. The combustor 30 may increase the temperature of the combustion gas to a temperature at which the combustor 30 and turbine 50 are able to be resistant to heat in a constant-pressure combustion process.

The combustor 30 may consist of a plurality of combustors arranged in the direction of rotation of the rotor 60 in the combustor housing 44.

Each of the combustors 30 may include a liner into which the air compressed by the compressor 20 is introduced, a burner that injects fuel into the air introduced into the liner for combustion, and a transition piece that guides the combustion gas produced by the burner to the turbine 50.

The liner may include a flame container that defines a combustion chamber, and a flow sleeve that surrounds the flame container and defines an annular space.

The burner may include a fuel injection nozzle that is formed at the front end of the liner to inject fuel into the air introduced into the combustion chamber, and an ignition plug that is formed on the wall of the liner to ignite air and fuel mixed in the combustion chamber.

The transition piece may be configured such that the outer wall thereof is cooled by the air supplied from the compressor 20 to prevent damage to the transition piece by the high temperature of combustion gas.

The transition piece may have a cooling hole formed for injection of air thereinto, and the main body in the transition piece may be cooled by the air introduced through the cooling hole.

The air used to cool the transition piece may flow into the annular space of the liner, and may impinge on cooling air supplied through the cooling hole formed in the flow sleeve from the outside of the flow sleeve in the outer wall of the liner.

Although not separately illustrated in the drawings, a so-called desworler serving as a guide vane may be formed between the compressor 20 and the combustor 30 to adapt the angle of flow of air, introduced into the combustor 30, to a design angle of flow.

The turbine 50 may include a turbine blade 51 that rotates together with the rotor 60, and a turbine vane 52 that is fixedly installed in the housing 40 to align the flow of air introduced into the turbine blade 51.

The turbine blade 51 may consist of a plurality of turbine blades arranged in a multistage manner in the axial direction of the rotor 60, and the plurality of turbine blades 51 may be formed radially in the direction of rotation of the rotor 60 for each stage.

Each of the turbine blades 51 may include a plate-shaped turbine blade platform, a turbine blade root that extends inward from the turbine blade platform in the radial direction of the rotor 60, and a turbine blade airfoil that extends outward from the turbine blade platform in the radial direction of the rotor 60.

The turbine blade platform may be in contact with a turbine blade platform adjacent thereto, and serve to maintain the distance between the turbine blade airfoil and another turbine blade airfoil.

The turbine blade root may be formed in a so-called axial-type manner in which the turbine blade root is inserted into the above-mentioned turbine blade coupling slot in the axial direction of the rotor 60.

The turbine blade root may have a fir-tree shape so as to correspond to the turbine blade coupling slot.

Although the turbine blade root and the turbine blade coupling slot have a fir-tree shape in the present embodiment, the present disclosure is not limited thereto. For example, they may also have a dovetail shape or the like.

Alternatively, the turbine blade 51 may be fastened to the turbine rotor disk 63 using a fastener other than the above form, for example using a fixture such as a key or a bolt.

In order to easily fasten the turbine blade root to the turbine blade coupling slot, the size of the turbine blade coupling slot may be greater than that of the turbine blade root.

In addition, a gap may be formed between the turbine blade root and the turbine blade coupling slot in the state in which they are coupled to each other.

Although not separately illustrated in the drawings, the turbine blade root may be fixed to the turbine blade coupling slot by a separate pin to prevent the decoupling of the turbine blade root from the turbine blade coupling slot in the axial direction of the rotor 60.

The turbine blade airfoil may have an optimized airfoil shape according to the specifications of the gas turbine, and include a leading edge that is positioned upstream in the flow direction of combustion gas so that combustion gas flows to the leading edge, and a trailing edge that is positioned downstream in the flow direction of combustion gas so that combustion gas flows from the trailing edge.

The turbine vane 52 may consist of a plurality of turbine vanes formed in a multistage manner in the axial direction of the rotor 60. Here, the turbine vane 52 and the turbine blade 51 may be arranged alternately in the flow direction of air.

The plurality of turbine vanes 52 may be formed radially in the direction of rotation of the rotor 60 for each stage.

Each of the turbine vanes 52 may include an annular turbine vane platform that is formed in the direction of rotation of the rotor 60, and a turbine vane airfoil that extends from the turbine vane platform in the direction of rotation of the rotor 60.

The turbine vane platform may include a root-side turbine vane platform that is formed at the airfoil root portion of the turbine vane airfoil to be fastened to the turbine housing 46, and a tip-side turbine vane platform that is formed at the airfoil tip portion of the turbine vane airfoil to face the rotor 60.

Although the turbine vane platform includes the root-side turbine vane platform and the tip-side turbine vane platform to more stably support the turbine vane airfoil by supporting the airfoil tip portion of the turbine vane airfoil as well as the airfoil root portion thereof in the present embodiment, the present disclosure is not limited thereto.

That is, the turbine vane platform may also include the root-side turbine vane platform to support only the airfoil root portion of the turbine vane airfoil.

The turbine vane airfoil may have an optimized airfoil shape according to the specifications of the gas turbine, and include a leading edge that is positioned upstream in the flow direction of combustion gas so that combustion gas flows to the leading edge, and a trailing edge that is positioned downstream in the flow direction of combustion gas so that combustion gas flows from the trailing edge.

Since the turbine 50 comes into contact with high-temperature and high-pressure combustion gas unlike the compressor 20, there is a need for a cooling means for preventing damage such as deterioration.

The gas turbine according to the present embodiment may further include a cooling passage through which some of the air compressed in the compressor 20 is bled from a partial position thereof to be supplied to the turbine 50.

The cooling passage may extend outside the housing 40 (external passage), may extend through the inside of the rotor 60 (internal passage), or both the external passage and the internal passage may be employed.

The cooling passage may communicate with a turbine blade cooling passage formed in the turbine blade 51 such that the turbine blade 51 is cooled by cooling air.

The turbine blade cooling passage may communicate with a turbine blade film cooling hole formed in the surface of the turbine blade 51 so that cooling air is supplied to the surface of the turbine blade 51, thereby enabling the turbine blade 51 to be cooled by the cooling air in a so-called film cooling manner.

Besides, the turbine vane 52 may also be cooled by the cooling air supplied from the cooling passage, similar to the turbine blade 51.

Meanwhile, the turbine 50 requires a gap between the blade tip of the turbine blade 51 and the inner peripheral surface of the turbine housing 46 such that the turbine blade 51 is smoothly rotatable.

However, it is advantageous in terms of prevention of interference between the turbine blade 51 and the turbine housing 46 but it is disadvantageous in terms of leakage of combustion gas if the gap is too large, and vice versa if the gap is too small.

That is, the flow of combustion gas injected from the combustor 30 may be sorted into a main flow in which combustion gas flows through the turbine blade 51, and a leakage flow in which combustion gas flows through the gap between the turbine blade 51 and the turbine housing 46. The leakage flow increases as the gap is large, which can prevent the interference between the turbine blade 51 and the turbine housing 46 due to thermal deformation or the like and thus damage though the efficiency of the gas turbine is reduced.

On the other hand, the leakage flow decreases if the gap is small, which enhances the efficiency of the gas turbine but may lead to the interference between the turbine blade 51 and the turbine housing 46 due to thermal deformation or the like and may thus lead to damage.

The gas turbine according to the present embodiment may further include a sealing means for secure an appropriate gap to minimize a reduction in gas turbine efficiency while preventing the interference between the turbine blade 51 and the turbine housing 46 to thus prevent damage.

The sealing means may include a shroud that is positioned at the blade tip of the turbine blade 51, a labyrinth seal that protrudes outward from the shroud in the radial direction of the rotor 60, and a honeycomb seal that is installed on the inner peripheral surface of the turbine housing 46.

The sealing means having such a configuration may form an appropriate gap between the labyrinth seal and the honeycomb seal to minimize a reduction in gas turbine efficiency due to the leakage of combustion gas and to prevent the direct contact between the high-speed rotating shroud and the fixed honeycomb seal and thus damage.

The turbine 50 may further include a sealing means for blocking the leakage between the turbine vane 52 and the rotor 60. To this end, a brush seal and the like may be used in addition to the above labyrinth seal.

In the gas turbine having such a configuration, air introduced into the housing is compressed by the compressor 20, the air compressed by the compressor 20 is mixed with fuel for combustion and then converted into combustion gas in the combustor 30, and the combustion gas produced by the combustor 30 is introduced into the turbine 50.

The combustion gas introduced into the turbine 50 rotates the rotor 60 through the turbine blade 51 and is then discharged to the atmosphere through the diffuser, and the rotor 60 rotated by the combustion gas drives the compressor 20 and the generator.

That is, some of the mechanical energy obtained from the turbine 50 may be supplied as energy required for compression of air in the compressor 20, and the remainder may be used to produce electric power by the generator.

Hereinafter, a gas turbine disk according to the first embodiment of the present disclosure will be described with reference to the accompanying drawings. For reference, FIG. 2 is a view illustrating a disk unit according to the first embodiment of the present disclosure, FIG. 3 is a view illustrating a modified example of FIG. 2, and FIG. 4 is a view illustrating another modified example of FIG. 2.

Referring to FIG. 2, the structure of the gas turbine disk according to the first embodiment of the present disclosure is modified in various forms to prevent a local occurrence of stress concentration when cooling air is supplied to a cooling target, in order to stably supply the cooling air and minimize deformation caused by the stress concentration.

To this end, the gas turbine disk according to the present embodiment includes a cooling target 100 related to a gas turbine, and a disk unit 200 having a main passage 210 that is open to supply cooling air to the cooling target 100, and a plurality of unit passages 220 that are open at the end of the main passage 210 while each having a predetermined size. For reference, the unit passages 220 are formed in such a manner that the open area of the main passage 210 is segmented into N areas in the drawing to guide the segmentation flow of cooling air.

Although the cooling target 100 is a blade, the present disclosure is not necessarily limited thereto. The cooling target 100 may be other components in need of cooling.

In the present embodiment, the main passage 210, for example, extends obliquely in one direction in the disk unit 200, and the unit passages 220 are open vertically toward the cooling target 100.

Cooling air flows to the individual unit passages 220 via the main passage 210. The unit passages 220 do not have the same diameter and each have a diameter smaller than the main passage 210.

The reason the unit passages 220 do not have the same diameter is to reduce a stress concentration area due to contact with cooling air and minimize deformation caused by stress.

Cooling air flows to the cooling target 100 via the spaces defined by the unit passages 220. In this case, since the stress applied to each of the unit passages 220 is distributed, a problem relating to the stress concentration is minimized.

In the present embodiment, each of the unit passages 220 has a rounded portion 220*a* formed at the lower side thereof. Since the rounded portion 220*a* is a contact portion with cooling air, which is rounded rather than sharp, it is possible to minimize a stress concentration phenomenon.

When cooling air comes into direct contact with the rounded portion 220*a*, a stress is supported by and distributed along the curved surface of the rounded portion, thereby minimizing a stress concentration phenomenon.

Therefore, it is possible to minimize deformation caused by the stress due to the cooling air supplied to the cooling target 100 on condition that the disk unit 200 is used for a long time.

In the present embodiment, the unit passage 220 has a spiral groove portion 222 formed circumferentially therein. The groove portion 222 guides cooling air in a spiral form in the flow direction thereof to supply cooling air to the cooling target 100.

Referring to FIG. 3, in a modified example of the present embodiment, the unit passages 220 are obliquely open toward the cooling target 100. The unit passages 220 may be inclined in different directions, in the same direction, or in an unspecified direction, and the direction thereof is not necessarily limited to the direction illustrated in the drawing.

In this case, cooling air may be supplied to all areas of the cooling target 100, thereby realizing an improvement in cooling efficiency.

In the modified example, the unit passages 220 are open in one of circular, elliptical, and polygonal forms. The reason is to supply a maximum amount of cooling air to the cooling target 100 under the condition of a minimum area considering the layout of the disk unit 200.

Referring to FIG. 4, the main passage 210 includes a first extension section S1 formed to have a first length in the total extension section S to the unit passages 220, and a second extension section S2 that extends from the extended end of the first extension section S1 to the unit passages 220 while having a second length, and a diameter d1 of the first extension section S1 differs from a diameter d2 of the second extension section S2.

Each of the first and second extension sections S1 and S2 may have a length different from the length illustrated in the drawing, according to the specification of the disk unit 200.

Since the diameter d1 of the first extension section S1 differs from the diameter d2 of the second extension section S2, it is possible to adjust a position at which stress concentration occurs due to the flow of cooling air.

For example, in the case where the stress concentration occurs in the second extension section S2, when the diameter d1 of the first extension section S1 is greater than the diameter d2 of the second extension section S2, the stress concentration in the second extension section S2 is relatively reduced.

Thus, since cooling air stably flows to the cooling target 100 and the stress concentration may be minimized, it is possible to minimize deformation caused by the stress.

In an embodiment of the present disclosure, there is provided a gas turbine including a disk unit 200. In the gas turbine, it is possible to stably cool the disk unit 200 and minimize the deformation thereof due to the stress concentration, thereby improving the durability of the high-expensive disk unit 200.

In an embodiment of the present disclosure, there is provided a method of manufacturing a gas turbine including a disk unit 200 having a main passage 210 and a plurality of unit passages 220. The main passage 210 and the unit passages 220 may be easily manufactured by various methods such as casting or drilling machining after casting by a worker.

Hereinafter, a gas turbine disk according to a second embodiment of the present disclosure will be described with reference to the accompanying drawings. The present embodiment differs from the above-mentioned first embodiment in that cooling air is supplied to a high-temperature area of a cooling target 100 through first and second branch passages 220*aa* and 230*a*, in which case the cooling air is branched from the main passage 210 and then supplied to the cooling target 100.

In addition, the present embodiment differs from the above-mentioned first embodiment in that cooling air is supplied to the high-temperature area of the cooling target 100 in which high temperature is maintained, and an area except for the high-temperature area, thereby performing stable cooling and minimizing a stress concentration phenomenon.

Referring to FIG. 5, the first and second branch passages 220*aa* and 230*a* according to the present embodiment have second expansion portions 224*a* and 234*a* that are rounded and expanded circumferentially outward in the respective open upper sides thereof. The second expansion portions 224*a* and 234*a* may increase an open area to expand the movement of the cooling air supplied to the cooling target 100.

Each of the second expansion portions 224*a* and 234*a* has a rounded streamlined inner peripheral surface to guide the stable flow of cooling air.

Accordingly, the cooling air flows to the cooling target 100 from the second expansion portions 224*a* and 234*a* in the state in which the loss thereof is reduced.

Hereinafter, a gas turbine disk according to a third embodiment of the present disclosure will be described with reference to the accompanying drawings.

Referring to FIG. 6, the gas turbine disk according to the second embodiment of the present disclosure includes a cooling target 100 related to a gas turbine, and a disk unit 200 having a main passage 210 that is open to supply cooling air to the cooling target 100, a first branch passage 220*aa* that is branched from the main passage 210 to supply cooling air to a high-temperature area in the extended path of the main passage 210, and a second branch passage 230*a* that is separated from the first branch passage 220*aa* to supply cooling air to the remainder area of the cooling target 100.

The main passage 210 extends to the cooling target 100 as illustrated in the drawing, and the first branch passage 220*aa* is branched to the cooling target 100 from an arbitrary position in the extended path of the main passage 210.

The first branch passage 220*aa* is branched at a right angle to the cooling target 100 from the main passage 210, to supply cooling air to the leading edge of the cooling target 100.

The second branch passage 230*a* is branched to the cooling target 100 from the extended end of the main passage 210.

The first branch passage 220*aa* has a diameter greater than the second branch passage 230*a*. The reason is because the supply of a large amount of cooling air to the high-temperature area of the cooling target 100 helps improve cooling efficiency.

The first branch passage 220*aa* is branched adjacent to the main passage 210 rather than the second branch passage 230*a*. When the first branch passage 220*aa* is branched from a front end portion or a position between the front end portion and an intermediate portion, rather than a rear end portion, in the extended path of the main passage 210, it is possible to rapidly move cooling air and minimize a stress concentration phenomenon through the reduction of the movement path of the cooling air.

In the present embodiment, the main passage 210 may have a diameter that is uniformly maintained in the extended section between the first branch passage 220*aa* and the second branch passage 230*a* and is reduced to the extended end thereof.

When the first and second branch passages 220*aa* and 230*a* are rarely changed in diameter or have the same diameter, it is possible to reduce a variation in velocity energy due to the flow rate change of cooling air.

The flow rate change of cooling air may increase or decrease deformation caused by the stress concentration at a specific position when the cooling air flows from the main passage 210 to the first or second branch passage 220*aa* or 230*a*. Therefore, this configuration is advantageous to realize a reduction in stress.

The first branch passage 220*aa* has a first expansion portion 222*a* formed to have a predetermined diameter and depth at the open end thereof. The first expansion portion 222*a* is formed to reduce a stress concentration phenomenon. The reason the first expansion portion 222*a* is formed at the position is to supply a larger amount of cooling air to the leading edge of the cooling target 100.

Referring to FIG. 7, the gas turbine disk according to the present embodiment includes a cooling target 100 related to a gas turbine, and a disk unit 2000 having main passages 2100 that are open to supply cooling air to the cooling target 100, and branch passages 2300 that are connected to the extended ends of the respective main passages 2100, communicate with the cooling target 100, and have a diameter different from the main passages 2100, and the main passages 2100 and the branch passages 2300 are symmetrically disposed in the lower side of the disk unit 2000.

The present embodiment relates to the arrangement of the main passages 2100 and the branch passages 2300, and they are bilateral symmetrical to each other in the drawing of FIG. 7.

When the main passages 2100 and the branch passages 2300 are symmetrically disposed in the disk unit 2000, cooling air is supplied to the cooling target 100 in the state in which the flow and flow rate of the cooling air are kept uniform at the left and right sides of the disk unit 2000.

In this case, the stresses applied to the main passages 2100 and the branch passages 2300 are reduced compared to those applied to a single passage and cooling air is uniformly supplied to the cooling target 100, thereby improving cooling efficiency.

Each of the branch passages 2300 is inclined at an angle within 30° with respect to an associated one of the main passages 2100. The angle is set considering the layout of the disk unit 2000, and the branch passage 2300 is preferably inclined at the above angle to stably move cooling air and minimize a stress concentration phenomenon.

For example, when the branch passage is inclined at an angle of 40° or 45° that is greater than the above angle, the stable flow of cooling air is deteriorated and a stress may occur at a position in which the angle is changed. Therefore, the branch passage is preferably inclined within the above angle.

The branch passage 2300 has a rounded portion 2310 that is rounded outward at the end thereof facing the cooling target 100. The rounded portion 2310 may reduce a stress concentration phenomenon due to cooling air, thereby improving the durability of the disk unit.

The main passage 2100 is longer than the branch passage 2300. The main passage 2100 is elongated to stably supply cooling air to the branch passage 2300, and it is possible to reduce the stress applied to the branch passage 2300 or a stress concentration area.

Hereinafter, a gas turbine disk according to a fourth embodiment of the present disclosure will be described with reference to the accompanying drawings. In the present embodiment, cooling air is supplied to a cooling target 100 through a segmentation passage 2200 segmented from a main passage 2100.

Referring to FIG. 8, the gas turbine disk according to the present embodiment includes a cooling target 100 related to a gas turbine, and a disk unit 2000 having a main passage 2100 that extends to supply cooling air to the cooling target 100, and a segmentation passage 2200 that is segmented and extends from the main passage 2100 to supply the cooling air to the leading edge 102 of the cooling target 100.

The main passage 2100 extends to have a path illustrated in the drawing in the disk unit 2000, and the end thereof extends downward of the cooling target 100.

The cooling air is supplied to the cooling target 100 through the main passage 2100 to cool the cooling target 1000.

The segmentation passage 2200 extends to the leading edge of the cooling target 100 from the intermediate position of the main passage 2100 to supply the cooling air thereto.

Since cooling air flows along the main passage 2100 and are then branched to the segmentation passage 2200, a stress concentration phenomenon is reduced compared to when entire cooling air flows through a single passage.

Since the segmentation passage 2200 is inclined at an angle of about 45° with respect to the main passage 2100, cooling air flows without rapid direction switching even when it flows to the segmentation passage 2200.

Thus, the stability of cooling air flowing from the main passage 2100 to the segmentation passage 2200 is improved.

In the present embodiment, the segmentation passage 2200 has a rounded portion 2400 formed at a position in which it is segmented from the main passage 2100. The rounded portion 2400 may minimize a stress concentration phenomenon due to the contact with cooling air, thereby reducing deformation caused by the stress.

As is apparent from the above description, in accordance with the exemplary embodiments of the present disclosure, it is possible to provide a gas turbine disk having improved durability by reducing stress concentration in the disk unit of the gas turbine and minimizing fatigue failure and deformation caused by the stress concentration.

In addition, it is possible to efficiently cool a cooling target together with the stable supply of cooling air by diversifying the flow path of the cooling air.

Although the present disclosure has been described with respect to the specific embodiments, it will be apparent to those skilled in the art that various variations and modifications may be made by adding, changing, or removing components without departing from the spirit and scope of the disclosure as defined in the following claims, and these variations and modifications fall within the spirit and scope of the disclosure as defined in the appended claims.

What is claimed is:

1. A gas turbine disk comprising:

a cooling target related to a gas turbine; and a disk unit having a main passage that is open to supply cooling air to the cooling target, and a plurality of unit passages that are open at an end of the main passage while each having a predetermined size, wherein the main passage extends obliquely with respect to a radial direction of the disk unit, and each of the plurality of unit passages extends in the radial direction of the disk unit, and wherein the main passage comprises:

a first extension section formed to have a first length in a total extension section to the plurality of unit passages, the first extension section having one end extending radially outwardly toward the end of the main passage; and a second extension section extending radially outwardly from the one end of the first extension section to the plurality of unit passages and having a second length, the second extension section having a diameter less than a diameter of the first extension section and having the second length less than the first length of the first extension section.

2. The gas turbine disk according to claim 1, wherein the unit passages are open vertically toward the cooling target.

3. The gas turbine disk according to claim 1, wherein the unit passages are open obliquely toward the cooling target.

4. The gas turbine disk according to claim 1, wherein each of the plurality of unit passages has a lower side at which a rounded portion is formed.

5. The gas turbine disk according to claim 1, wherein each of the unit passages has a spiral groove portion formed circumferentially therein.

6. A gas turbine disk comprising:

a cooling target related to a gas turbine; and a disk unit including:

a main passage that is open to supply cooling air to the cooling target, a first branch passage having an outlet from which the cooling air supplied to the main passage exits toward the cooling target, the first branch passage branched from the main passage to supply cooling air to a high-temperature area in an extended path of the main passage, the high-temperature area including a leading edge of the cooling target, a second branch passage separated from the first branch passage to supply cooling air to a remainder area of the cooling target, and a first expansion portion to supply a larger amount of the cooling air to the leading edge of the cooling target than to the remainder area of the cooling target, the first expansion portion formed only in a leading edge side of the outlet of the first branch passage.

7. The gas turbine disk according to claim 6, wherein the first branch passage has a diameter greater than the second branch passage.

8. The gas turbine disk according to claim 6, wherein the first branch passage is branched adjacent to the main passage rather than the second branch passage.

9. The gas turbine disk according to claim 6, wherein the main passage has a diameter that is uniformly maintained in an extended section between the first branch passage and the second branch passage.

10. The gas turbine disk according to claim 6, wherein the first expansion portion has a predetermined width and depth.

11. The gas turbine disk according to claim 6, wherein the second branch passage has an outlet from which the cooling air supplied to the main passage exits toward the cooling target, and wherein the disk unit further includes a second expansion portion formed only in one side of the outlet of the second branch passage.

* * * * *